US006013141A

United States Patent [19]

Nylen et al.

[11] Patent Number: 6,013,141

[45] Date of Patent: Jan. 11, 2000

[54] CAST IRON INDEFINITE CHILL ROLL PRODUCED BY THE ADDITION OF NIOBIUM

[75] Inventors: Bo Tommy Kage Nylen, Timotejvagen, Sweden; Thomas P. Adams, Pittsburgh, Pa.

[73] Assignee: Akers International AB, Styckebruk, Sweden

[21] Appl. No.: 08/973,274

[22] PCT Filed: Jun. 4, 1996

[86] PCT No.: PCT/US96/09181

§ 371 Date: Dec. 5, 1997

§ 102(e) Date: Dec. 5, 1997

[87] PCT Pub. No.: WO96/39544

PCT Pub. Date: Dec. 12, 1996

Related U.S. Application Data

[63] Continuation-in-part of application No. 08/466,996, Jun. 6, 1995, abandoned.

[51] Int. Cl.[7] ..... C22C 37/08; C22C 37/00; C21D 5/14

[52] U.S. Cl. ..... 148/323; 148/545

[58] Field of Search ..... 420/13, 17, 32; 148/321, 323, 545

[56] References Cited

U.S. PATENT DOCUMENTS

| | | |
|---|---|---|
| Re. 26,122 | 12/1966 | Semmel . |
| 2,008,196 | 7/1935 | Weber . |
| 2,150,555 | 3/1939 | Leemans . |
| 2,838,395 | 6/1958 | Rhodin . |
| 3,459,540 | 8/1969 | Tisdale . |
| 3,659,323 | 5/1972 | Hachisu et al. . |
| 3,670,800 | 6/1972 | DeVos . |
| 3,754,593 | 8/1973 | Stone . |
| 3,894,325 | 7/1975 | Maruta et al. . |
| 3,909,252 | 9/1975 | Kuriyama et al. . |
| 3,929,471 | 12/1975 | Akahori et al. . |
| 3,972,366 | 8/1976 | Dugan . |
| 4,117,877 | 10/1978 | Yokota . |
| 4,638,847 | 1/1987 | Day . |
| 5,312,056 | 5/1994 | Kästingschäfer et al. . |
| 5,316,596 | 5/1994 | Kataoka . |
| 5,355,932 | 10/1994 | Nawata et al. . |

FOREIGN PATENT DOCUMENTS

| | | |
|---|---|---|
| 0 525 932 A1 | 2/1993 | European Pat. Off. . |
| 57-149452 | 9/1982 | Japan . |
| 62-136556 | 6/1987 | Japan . |
| WO 94/11541 | 5/1994 | WIPO . |

OTHER PUBLICATIONS

Patent Abstracts of Japan, Publication No. 62136556, Published Jun. 19, 1987 (Kawasaki Steel Corp.).

Patent Abstracts of Japan, Publication No. 57149452, Published Jun. 16, 1982 (Kubota Ltd.).

English language translation of Japanese reference No. 62–136556 A.

English language translation of Japanese reference No. 57–149452 A.

*Primary Examiner*—Deborah Yee

*Attorney, Agent, or Firm*—Kirkpatrick & Lockhart LLP

[57] ABSTRACT

An indefinite chill roll alloy composition is disclosed containing carbon ranging from 2.5 to 4.0% by weight of the alloy and the carbon is present as free graphite in an amount ranging from 2–7%, preferably 3–6%, of the total carbon. The composition further includes niobium which ranges from 0.3–6.0 % and is present essentially as discrete niobium carbide particles in the alloy. The present invention further includes a chill roll shell formed from the alloy and produced by a method including the steps of providing a molten indefinite chill roll composition, adjusting the composition by adding niobium in an amount sufficient to produce a molten batch containing 0.3 to 6.0% niobium based on the total weight of said molten batch, providing a stoichiometric amount of excess carbon to form niobium carbide and casting the molten batch to form the chill roll shell. The method of the present invention may be useful to form indefinite chill roll containing significant quantities of carbides from other element that form carbides having low carbide solubilities near the eutectic point of the iron alloy, while maintaining sufficient free graphite in the alloy to produce an alloy having the properties required for chill roll applications.

20 Claims, No Drawings

CAST IRON INDEFINITE CHILL ROLL PRODUCED BY THE ADDITION OF NIOBIUM

This application claims priority under 35 U.S.C. §365 (c) from PCT/US96/09181 filed Jun. 4, 1996, which is a continuation in part of U.S. patent application Ser. No. 08/466,996 filed on Jun. 6, 1995 abandoned.

BACKGROUND OF THE INVENTION

1. Field of the Invention

The invention relates to a process for producing a chill roll having surface properties that are highly desirable for use in the hot rolling of steel. More particularly, the invention relates to the discovery that the introduction of niobium into a chilled-iron roll casting composition produces surface hardness values not previously attainable without interfering with the balance between carbide formation and free graphite dispersion that is necessary in such casting compositions.

2. Background of the Invention

In the continuous hot rolling of steel strip, a continuously moving steel workpiece (the strip) is passed through a rolling mill which commonly consists of several stands of rolls arranged in a straight line (in tandem). The strip cools as it passes through the rolling mill, such that each succeeding stand is at a lower temperature than its predecessor stand. Typically, when the strip reaches the rolls of the last few mill stands there is a tendency of the strip to weld or fuse to the rolls through which it passes because of the lower temperature of the roll. The results of such welding can be a catastrophic demolition of the rolling mill stands and surrounding structures, not to mention the grave threat to workers in the area.

It is evident, therefore, that the selection of the proper grade of roll to be used in the latter stands of tandem style rolling mills is important. The problem of roll selection is complicated by the fact that mill conditions vary widely, but in general the finishing rolls on a tandem hot mill should have an outer skin which is dense and hard, and yet provide sufficiently low friction in the areas that contact the workpiece.

Since the early days of steelmaking, rolling mill rolls have been cast in a manner to ensure that the liquid iron on the outer surface of the roll is cooled to produce the desired structure and properties. One technique for attaining this rapid cooling is to insert metal rings or segments, called "chills", in the mold, close to the surface to be contacted by the molten iron. The production of the chill roll shells typically involves a two step process, in which an outer shell in formed that possesses the aforementioned qualities necessary for use in a rolling mill followed by the formation of an inner core composed of a material that provides additional strength to the chill roll, such as cast iron. The outer shell is formed by either a static or spin pour, as is well known in the industry, an example of which is U.S. Pat. No. 5,355,932 issued to Nawata et al.

Most early chill rolls were cast using ordinary low silicon iron alloyed with nickel and chromium and chilled at a very high rate to suppress the formation of graphite, which was thought to be detrimental to the roll due to the softness imparted to the alloy by the graphite. The chilled outer surface is very hard and, when fractured, has a white fracture face for a distance beneath the surface (known as the chill zone), signifying that the formation of free graphite in that area had been suppressed by the rapid cooling. The white iron zone sometimes is referred to as "white cast iron", as contrasted with iron containing graphite that has a grey fracture face, known as "grey iron".

In the 1930s, it was discovered that the introduction of finely dispersed graphite into the white iron zone substantially reduced roll breakage despite providing for a softer outer shell. The region of the finely dispersed graphite in the alloy is termed "mottled." The presence of graphite in the outer shell greatly improves the ability of the roll to withstand the thermal shocks associated with hot rolling steel strip, reduces the friction between the roll and the strip thereby lowering the applied stress on the strip, and greatly reduces the potential for fusing of the strip to the roll. As a result, white cast iron chill rolls were largely superseded by a roll characterized by finely dispersed graphite near the outer surface of the roll and the lack of a definite chill zone. Such a roll has become known as an "indefinite chill" roll (or a "grain" roll).

While indefinite chill rolls significantly improve the durability of the roll over white cast chill rolls, the presence of graphite provides for a softer roll having a lower wear resistance and a shorter usable life between regrinds than the more highly alloyed rolls in the same finishing stands. Considerable efforts have been made worldwide to develop rolls which do not weld to the steel strip being rolled and have a better resistance to abrasion than the indefinite chill rolls. A primary focus of the efforts is on the use of metallic carbides to increase the hardness and abrasion resistance of an iron alloy as is known in the art; however, increasing the amount of carbides generally produces a commensurate reduction in the amount of graphite in the alloy. Numerous attempts have been made to develop alloys containing potent combinations of strong carbide forming elements, such as are used in tool steels, to replace the indefinite chill roll compositions. However, these high carbide, low graphite alloy rolls have also proven to be unsuitable for chill roll applications, because of the tendency to weld to the material being rolled and to initiate pressure cracks, much like the white cast iron chill rolls. For lack of a superior alternative, indefinite chill rolls have been retained in the late finishing stands of many of the modern high speed hot strip mills and the use of potent carbide forming elements has been limited to relatively small additions, usually of molybdenum, to indefinite chill roll compositions to alter the matrix structure or extremely small additions of magnesium to control the form of the graphite.

An essential feature of indefinite chill rolls is the critical balance between alloying elements such as carbon, nickel and silicon which promote the formation of graphite and carbide forming elements such as chromium. The formation of an alloy containing the proper balance of graphite and carbides requires extremely careful selection of melting stock, closely controlled melting conditions, rigid control of composition and inoculation techniques to obtain the required type and distribution of graphite. This relationship has inhibited the use of more potent carbide forming elements which greatly skew the graphite/carbide balance in favor of carbide formation and render the alloy unsuitable for use in indefinite chill roll applications. Thus, for over four decades the use of potent carbide forming alloys has been inhibited by the overwhelming need to maintain free graphite in the chilled structure of this type of roll.

One effort to improve the wear resistance of the chill roll material is presented in International Application Number PCT/GB93/02380 (the "'2380 application") published as International Publication Number WO 94/11541. The '2380 application discloses indefinite chill roll compositions produced by the introduction of solid carbide particles into a molten indefinite chill roll composition, and the subsequent solidification of the molten composition containing the solid carbide particles to produce a chill roll having encapsulated solid carbide particles.

As discussed in the '2380 application, both the methods of production and the resulting compositions encounter significant difficulties in material uniformity and carbide particle integration and elemental diffusion between the molten chill roll matrix and solid carbide particles introduced into the matrix. For example, coatings must be applied to the particles to help ensure adequate wetting of the particles by the molten chill roll matrix and proper solidification of the encapsulated particles in the matrix. Also, the composition of the coating material and the solid carbide particles and the introduction of the carbide particles must be precisely controlled to minimize elemental diffusion as a result of the nonequilibrium conditions between the solid carbide particles and the molten chill roll matrix. As such, the compositions and methods disclosed in the '2380 application do not provide a satisfactory solution to the problems associated with increasing the hardness and improving the wear resistance of indefinite chill roll structures without adversely affecting the desirable properties of the chill roll compositions.

Many other applications require the characteristics embodied in indefinite chill rolls, such as in plate mills, temper mills, narrow strip, backup rolls, bar mills for rolling flats, Steckel mills and a variety of cold temper mills. In all of these applications the present advantages of this type of roll would be greatly enhanced by a significant improvement in its resistance to abrasion.

SUMMARY OF THE INVENTION

An indefinite chill roll alloy composition is disclosed containing carbon ranging from 2.5 to 4.0% by weight (all percentages herein being by weight of the alloy unless otherwise stated) of the alloy and the carbon is present as free graphite in an amount ranging from 2–7%, preferably 3–6%, of the total volume. The composition further includes niobium which ranges from 0.3–6.0% and is present essentially as discrete precipitated niobium carbide particles in the alloy. The present invention further includes a chill roll shell formed from the alloy produced by a method including the steps of (i) providing an indefinite chill roll composition, (ii) adjusting the composition by adding niobium in an amount sufficient to produce a molten batch containing 0.3 to 6.0% niobium based on the total weight of said molten batch, providing a stoichiometric amount of excess carbon to form niobium carbide and (iii) casting the molten batch to form the chill roll shell containing precipitated niobium carbide and carbon present as free graphite in an amount ranging from 2–7% of the total volume of the chill roll. The method of the present invention may be useful to form indefinite chill roll containing significant quantities of carbides from other elements that form carbides having low carbide solubilities near the eutectic point of the iron alloy, while maintaining sufficient free graphite in the alloy to produce an alloy have the properties required for chill roll applications.

The niobium indefinite chill roll composition greatly enhances the abrasion resistance of the indefinite chill type of roll without reducing its resistance to welding to the strip or its resistance to initiation of cracks under shock loading, by maintaining a balance between free graphite and carbides in the chilled zone during eutectic solidification.

In accordance with the present invention, the use of niobium allows the addition of a relatively large amount of a strong carbide forming element to a roll alloy which will retain its essential partially graphitized chilled structure. A consideration of the partitioning coefficients of other alloys which form carbides at high temperatures suggest that tantalum might also be suitable. Contrariwise, vanadium, tungsten, titanium, molybdenum, and chromium could be expected to dramatically upset the graphite-carbide balance during eutectic solidification and, therefore, are generally not suitable for chill roll applications. Thus, the present invention provides an indefinite chill roll composition that overcomes the problems associated with the prior art. These and other details, objects, and advantages of the invention will become apparent as the following detailed description of the present preferred embodiment thereof proceeds.

DETAILED DESCRIPTION OF PREFERRED EMBODIMENTS

As used herein, the term "indefinite chill roll" composition shall mean an iron-based alloy intended for use in casting the shell of a rolling mill roll and generally having the composition:

TABLE 1

KNOWN INDEFINITE CHILL ROLL COMPOSITIONS AND ROLLS FORMED THEREFROM

| Constituent | Weight Percent (wt %) (based on the total weight of the alloy) |
|---|---|
| Carbon | 2.5–3.6 |
| Nickel | 4.2–4.6 |
| Molybdenum | 0.3–0.5 |
| Chromium | 1.5–2.0 |
| Silicon | 0.7–1.2 |
| Manganese | 0.7–1.0 |
| Phosphorus | <0.07 |
| Sulfur | <0.08 |
| Iron and Impurities | Balance |

Alloys of this composition are well known in the art and will produce a proper balance or equilibrium between carbide formers and free graphite formers at the eutectic solidification temperature which is in the range of 1130° C. to 1150° C. The resulting alloy contains approximately 30–38% of the total volume in the form of carbides, carbon in the form of graphite occupies approximately 2–7% of the total volume and the remaining carbon is alloyed with the iron in the matrix of the alloy. Alloys having graphite present in quantities greater than 7% of the total volume are generally too soft to be employed as the outer shell of the rolling mill roll, while alloys containing less than 2% free graphite are not suitable to be deployed as a chill roll outer shell because they are not sufficiently resistant to thermal shock and do not have sufficient graphite to reliably prevent welding of the workpiece to the roll. The alloy produced from the indefinite chill roll compositions have a hardness value ranging from approximately 70 to 82 Shore C over the range of carbon used in the alloy.

Ni is added to the indefinite chill roll composition to promote the formation of free graphite in the alloy; however, an excess of Ni will tend to destabilize the structure of the alloy. Mo is important in the formation of the matrix structure and for controlling the size of the carbides formed in the cast, but Mo is also a potent carbide forming element, therefore Mo must be controlled to minimize excess amounts of Mo that will shift the graphite/carbide equilibrium almost entirely in favor of carbide formation. Cr is also a carbide forming element, but will not skew the graphite/ carbide balance as strongly in favor of carbide formation as potent carbide forming elements, such as V, if a balance is maintained with graphite promoting elements. Si and Mn are deoxidation agents that contribute to the formation of graphite and to maintaining the character of the cast, but will have an adverse affect on the crack resistance of the alloy, if present in higher amounts. P and S are generally present as contaminants in the alloy and should be minimized to a practical extent in the alloy, such as to less than 0.07% and 0.08%, respectively. The skilled practitioner will appreciate that minor changes to the elemental ranges and also substitution of comparably active elements can be made to the indefinite chill roll composition, while maintaining the desired properties characteristic of indefinite chill compositions containing free graphite as 2–7% of the total volume of the alloy.

While indefinite chill rolls can be produced within the above ranges, the composition and resulting properties of the chill roll can be more easily controlled and are more desirable if the compositional ranges are limited to those shown in Table 2, resulting in an alloy containing free graphite as 3–6% of the total volume.

TABLE 2

PREFERRED INDEFINITE CHILL ROLL COMPOSITIONS AND ROLLS FORMED THEREFROM

| Constituent | Weight Percent |
|---|---|
| Carbon | 3.2–3.4 |
| Nickel | 4.3–4.6 |
| Molybdenum | 0.3–0.5 |
| Chromium | 1.6–1.8 |
| Silicon | 0.7–0.9 |
| Manganese | 0.7–0.9 |
| Phosphorus | <0.07 |
| Sulfur | <0.08 |
| Iron and Impurities | Balance |

The Addition of Niobium

In the temperature range of the eutectic point of the molten indefinite chill roll compositions, niobium carbide has a very low solubility. The applicants have discovered that by adding niobium to the molten alloy and by cooling the molten alloy above the eutectic solidification temperature at a rate of not more than about 1° C./sec nearly all of the niobium will precipitate in the form of discrete niobium carbide particles and the solid niobium carbide does not affect either the chemistry of the remaining molten alloy or the formation of other precipitates upon the cooling of the remaining molten alloy to the eutectic temperature. Further, because solid niobium carbide particles are extremely hard (Vickers hardness above 2000), the presence of the carbides in the alloy substantially increases the abrasion resistance of the alloy. Niobium carbide is particularly effective in enhancing the hardness and abrasion resistance of the alloy because the particles have a density of approximately 7.8 g/cc which is very close to that of iron; therefore, the carbide particles will evenly distribute throughout the alloy matrix and will not either float or settle when the outer shell is formed either by static or spin pouring. The uniform distribution of the niobium carbide within the shell is especially important because the outer shell can withstand a number of surface regrinds to smooth the surface without a degradation in the physical characteristics of the shell. Niobium can be added to the alloy over a broad range of indefinite chill roll compositions as shown below:

TABLE 3

NIOBIUM CONTAINING INDEFINITE CHILL ROLL COMPOSITIONS AND ROLLS FORMED THEREFROM

| Constituent | Weight Percent |
|---|---|
| Carbon | 2.5–4.0 |
| Niobium | 0.3–6.0 |
| Nickel | 4.2–4.6 |
| Molybdenum | 0.3–0.5 |
| Chromium | 1.5–2.0 |
| Silicon | 0.7–1.2 |
| Manganese | 0.7–1.0 |
| Phosphorus | <0.07 |
| Sulfur | <0.08 |
| Iron and Impurities | Balance |

Another consequence of this discovery is that the once delicate equilibrium between graphite and carbides can now be manipulated using niobium to achieve a wide range of graphite to carbide ratios. Generally, manipulation of the graphite to carbide ratio can presumably be performed using any other carbide forming elements that have low carbide solubilities in molten indefinite chill roll alloy composition above the eutectic temperature. For example, elements having properties similar to niobium, such as tantalum, may also form carbides that have low solubility in molten indefinite chill roll compositions and could presumably function in a manner similar to niobium.

Preparation of the Alloy

Niobium carbide indefinite chill roll compositions can be prepared in a manner similar to methods typically used to prepare indefinite chill roll compositions. The niobium can be added to the alloy before or after the alloy is melted and in any form, such as niobium metal, ferro-niobium or niobium carbide, that will not shift the overall composition of the alloy to outside the prescribed ranges. The formation of niobium carbide requires that a stoichiometric amount of excess carbon be provided to produce the niobium carbide, while maintaining the desired carbon levels in the indefinite chill roll composition. Preferably, niobium and carbon are added in the form of niobium carbide that will be dissolved in the molten alloy and then precipitate upon cooling of the molten alloy. Ferro-niobium can also be used; however, excess carbon must also be added and the compositional ranges of the other alloying elements must take into account the addition of iron with the niobium. Niobium metal is not as desirable as either niobium carbide or ferro-niobium, because of the high melting temperature of the metal.

The preparation of the alloy requires heating a metal charge having an overall compositional range required for indefinite chill rolls, stated above, and including an amount of niobium and carbon to form the desired quantity of niobium carbide to approximately 1515°–1540° C. in an induction furnace for approximately 30–60 minutes or until an analysis of the molten metal indicates that the molten alloy is within the specifications. At which time, the molten alloy is cooled at a rate of approximately 1° C./sec until essentially all of the niobium carbide has precipitated from the molten alloy and the cooling is continued at a rate of approximately 0.25° C./sec until the eutectic point is reached and solidification of the remaining alloy occurs. In the preparation of the niobium containing alloys, a preferred range of alloy compositions shown in Table 4 were found to be more easily produced according to the aforementioned procedure and result in an alloy containing free graphite ranging from 3–6% of the total volume.

TABLE 4

PREFERRED NIOBIUM CONTAINING INDEFINITE CHILL ROLL COMPOSITIONS AND ROLLS FORMED THEREFROM

| Constituent | Weight Percent |
|---|---|
| Carbon | 3.3–3.7 |
| Niobium | 1.0–3.0 |
| Nickel | 4.3–4.6 |
| Molybdenum | 0.3–0.5 |
| Chromium | 1.6–1.8 |
| Silicon | 0.7–0.9 |
| Manganese | 0.7–0.9 |
| Phosphorus | <0.07 |
| Sulfur | <0.08 |
| Iron and Impurities | Balance |

EXAMPLES

A cast iron alloy was prepared in the aforementioned manner having the following compositional range:

| | |
|---|---|
| Carbon | 3.3–3.4% |
| Nickel | 4.5–4.6% |
| Chromium | 1.9–2.0% |
| Molybdenum | 0.4–0.5% |
| Silicon | 0.7–0.8% |
| Manganese | 0.9–1.0% |
| Phosphorus | 0.03–0.04% |
| Sulfur | 0.05–0.06% |

The resulting alloy had a hardness of 80 (Shore C). Using this alloy as a baseline indefinite chill roll composition, a number of niobium carbide alloy were cast by adding increasing amounts of ferro-niobium to the alloy without compensating for the carbon consumed in the niobium carbide precipitation or the additional iron introduced. The alloys were tested for hardness, the results of which are shown in Table 5 in comparison with the baseline alloy (alloy 0). Also included in the table is the calculated amount of carbon remaining in the eutectic solid taking into account the carbon consumed by the niobium and the addition of iron with niobium, assuming that all of the niobium precipitated as niobium carbide and using the average of the observed ranges for each element.

TABLE 5

HARDNESS OF ALLOY CAST IRON AS A FUNCTION OF NIOBIUM CONTENT

| Alloy Sample Number | % Niobium | Hardness % (Shore C) | Carbon Remaining in Alloy Matrix |
|---|---|---|---|
| 0 | 0.0 | 80 | 3.35 |
| 1 | 0.55 | 83 | 3.27 |
| 2 | 1.47 | 83 | 3.13 |
| 3 | 3.73 | 81 | 2.79 |
| 4 | 4.21 | 79 | 2.71 |
| 5 | 5.34 | 78 | 2.53 |
| 6 | 5.82 | 76 | 2.45 |

As shown in Table 5, the addition of even a small quantity (0.55%) results in significant improvement in the hardness. However, when the amount of niobium is increased without compensating for the consumption of carbon, the hardness of the material substantially decreases as with samples 4, 5, and 6. The significant effect of the decrease in the carbon content of the remaining alloy is indicative of the delicate balance sought to be achieved in the indefinite chill roll compositions. The addition of nearly 6% niobium results in an alloy having a hardness of only 76 Shore C, which is less than that of the baseline alloy, but which compares favorably to an alloy containing only 2.45% carbon in the matrix without niobium carbide present in the alloy. In general, the addition of niobium increases the hardness of the alloy by approximately 3 Shore C, which more importantly amounts to a significant increase in the abrasion resistance of the indefinite chill roll composition, while maintaining the necessary amount of free graphite in the alloy to function as a chill roll. The data in table 3 shows a maximum hardness is achieved when the niobium content ranges from 0.55 to 1.47 wt % and the carbon content ranges from 3.27 to 3.13 wt % of the total alloy. Additional testing indicates that the niobium content preferably ranges from 1.0 to 3 wt %, most preferably about 1.5 wt %, when the carbon content ranges from 3.3–3.45 wt %.

In addition, several chill rolls were prepared from the above alloys having dimensions approximately 30.5 inches in diameter and 70 inches long. One chill roll composed of the alloy containing niobium was placed in the last stand of a rolling mill and tested for comparison with an indefinite chill roll of the prior art, the results of which are shown in Table 6 below:

TABLE 6

INDEFINITE CHILL ROLL WEAR TESTING

| Roll Type | Number of Times in the Mill | Metric Tons of steel rolled per Millimeter of wear due to rolling and regrinding | Millimeters of wear per Time in the mill |
|---|---|---|---|
| Niobium containing Alloy | 108 | 2738 | 0.71 |
| Prior Art | 960 | 1889 | 1.05 |

As shown in Table 6, the niobium carbide indefinite chill rolls greatly increase the life expectancy by about 45% over existing chill rolls based on the metric tons of steel rolled per millimeter of wear due to rolling of the steel and regrinding of the roll between times or trips in the mill. In addition to increasing the length of time between shutting down the mill in order to regrind the chill roll, the niobium carbide chill roll results in a more consistent surface finish to the strip between regrinding because of the lower amount of wear in the surface of the roll.

Those of ordinary skill in the art will appreciate that the present invention provides significant advantages over the prior art. In particular, the subject invention overcomes the problems in the prior art, such as those disclosed in the '2380 application, to provide indefinite chill rolls that have increased abrasion resistance, thereby allowing for longer periods of operation before regrinding of the roll is necessary. The invention also provides for the production of a smooth workpiece because of the lower tendency for abrasions to form in the surface of the roll. The subject invention also increases the hardness of the indefinite chill roll, which further provides for a smoother workpiece. While the subject invention provides these and other advantages over the prior art, it will be understood, however, that various changes in the details, compositions and ranges of the elements which have been herein described and illustrated in order to explain the nature of the invention may be made by those skilled in the art within the principle and scope of the invention as expressed in the appended claims.

What is claimed is:

1. A chill roll shell formed of alloy cast iron and produced by a method comprising the steps of:

providing an indefinite chill roll composition;

adjusting said composition by adding niobium in an amount sufficient to produce a molten batch containing 0.3 to 6.0% dissolved niobium, based on the total weight of said molten batch, and providing a stoichiometric amount of excess carbon to form niobium carbide; and casting said molten batch to form said chill roll shell containing precipitated niobium carbide and carbon present as free graphite in an amount ranging from 2–7% of the total volume of said chill roll shell.

2. A method of varying the relative amounts of graphite and carbides in an iron alloy comprising the steps of:

providing an iron alloy composition having a eutectic solidification point at which a desired amount of graphite can be formed;

adjusting said iron alloy composition to allow for the formation of a desired amount of a carbide having a low solubility at the eutectic solidification point of said iron alloy composition by adding a sufficient amount of a carbide forming element and a stoichiometric amount of excess carbon capable of forming said carbide;

producing a molten batch from said iron alloy composition containing said carbide forming element above the eutectic solidification temperature of said iron alloy composition;

lowering the temperature of said molten batch to precipitate said carbide above the eutectic solidification point of said iron alloy composition; and, further cooling said molten iron alloy composition to form said desired amounts of graphite and carbide in said iron alloy.

3. The method of claim 2 wherein said step of adjusting further comprises adjusting said iron alloy composition by adding sufficient amount of niobium to form a desired amount of carbide in the form of niobium carbide.

4. The method of claim 3 wherein said step of adjusting further comprises adjusting said iron alloy composition by adding sufficient amount of niobium and excess carbon as niobium carbide.

5. The method of claim 3 wherein said step of adjusting further comprises adding niobium in an amount ranging from 0.3 to 6.0% of the total weight of said iron alloy.

6. The method of claim 5 wherein said step of adjusting comprises adding niobium in an amount ranging from 1.0 to 3.0% of the total weight of said iron alloy.

7. The method of claim 5 wherein said step of adjusting comprises adding niobium in an amount equalling 1.5% of the total weight of said iron alloy.

8. The method of claim 2 wherein said step of adjusting further comprises adjusting the composition to maintain an amount of graphite ranging from 2 to 7% of the total volume of said iron alloy.

9. The method of claim 8 wherein said step of adjusting further comprises adjusting the composition of said alloy having 2.5 to 4.0% carbon by total weight of said iron alloy.

10. In an indefinite chill roll alloy composition, an improved alloy comprising, by weight of said alloy:

2.5–4.0% carbon, wherein said carbon is present as free graphite in an amount ranging from 2–7% of the total volume of said alloy; and, 0.3–6.0% niobium, wherein said niobium is present essentially as discrete precipitated niobium carbide particles in said alloy.

11. An indefinite chill roll alloy composition comprising:

| | |
|---|---|
| Carbon | 2.5–4.0%, |
| Niobium | 0.3–6.0%, |
| Nickel | 4.2–4.6%, |
| Molybdenum | 0.3–0.5%, |
| Chromium | 1.5–2.0%, |
| Silicon | 0.7–1.2%, |
| Manganese | 0.7–1.0%, |

Iron and Impurities Balance, wherein said niobium is present in said alloy substantially as precipitated niobium carbide and said carbon is present as free graphite in an amount ranging from 2–7% of the total volume of said alloy.

12. The indefinite chill roll alloy composition of claim 11, wherein said niobium is present ranging from 1.0–3.0%.

13. The indefinite chill roll alloy composition of claim 12, wherein said niobium is present equalling 1.5%.

14. The indefinite chill roll alloy composition of claim 13, wherein said carbon is present ranging from 3.3–3.45%.

15. An indefinite chill roll alloy composition consisting essentially of by weight:

| | |
|---|---|
| Carbon | 2.5–4.0%, |
| Niobium | 0.3–6.0%, |
| Nickel | 4.2–4.6%, |
| Molybdenum | 0.3–0.5%, |
| Chromium | 1.5–2.0%, |
| Silicon | 0.7–1.2%, |
| Manganese | 0.7–1.0%, |

Iron and Impurities Balance, wherein said niobium is present in said alloy substantially as precipitated niobium carbide and said carbon is present as free graphite in an amount ranging from 2–7% of the total volume of said alloy.

16. The indefinite chill roll alloy composition of claim 15, wherein said niobium is present ranging from 1.0–3.0%.

17. The indefinite chill roll alloy composition of claim 16, wherein said niobium is present equalling 1.5%.

18. The indefinite chill roll alloy composition of claim 17, wherein said carbon is present ranging from 3.3–3.45%.

19. The shell of claim 1 wherein said step of casting further comprises:

precipitating niobium carbide from said molten batch; and, casting said molten batch to form said chill roll shell containing said niobium carbide precipitate and carbon present as free graphite in an amount ranging from 2–7% of the total volume of said chill roll shell.

20. The shell of claim 19 wherein said step of precipitating follows said step of casting.

* * * * *